US010145189B2

(12) United States Patent
Jonsson

(10) Patent No.: US 10,145,189 B2
(45) Date of Patent: Dec. 4, 2018

(54) DEVICE RELATING TO A FLUSHING HEAD FOR A ROCK DRILLING MACHINE AND ROCK DRILLING MACHINE

(71) Applicant: Atlas Copco Rock Drills AB, Orebro (SE)

(72) Inventor: Per Jonsson, Orebro (SE)

(73) Assignee: Epiroc Rock Drills Aktiebolag, Orebro (SE)

( * ) Notice: Subject to any disclaimer, the term of this patent is extended or adjusted under 35 U.S.C. 154(b) by 679 days.

(21) Appl. No.: 14/439,689

(22) PCT Filed: Oct. 29, 2013

(86) PCT No.: PCT/SE2013/051258

§ 371 (c)(1),
(2) Date: Apr. 30, 2015

(87) PCT Pub. No.: WO2014/081372

PCT Pub. Date: May 30, 2014

(65) Prior Publication Data

US 2015/0285014 A1 Oct. 8, 2015

(30) Foreign Application Priority Data

Nov. 21, 2012 (SE) ..... 1251313

(51) Int. Cl.

| | |
|---|---|
| ***E21B 21/00*** | (2006.01) |
| ***E21B 21/02*** | (2006.01) |
| *E21B 21/015* | (2006.01) |

(52) U.S. Cl.

CPC ..... *E21B 21/00* (2013.01); *E21B 21/02* (2013.01); *E21B 21/015* (2013.01)

(58) Field of Classification Search

CPC ..... B23B 27/10; B23B 51/06; B23B 51/042; B23B 51/0486; B23B 2231/24;

(Continued)

(56) References Cited

U.S. PATENT DOCUMENTS 1,682,438 A 8/1928 Sluthbridge et al.
3,610,348 A * 10/1971 Brooks ..... E21B 21/02 175/207

(Continued)

FOREIGN PATENT DOCUMENTS

| | | |
|---|---|---|
| DE | 4432472 | 3/1996 |
| EP | 0 113654 | 7/1984 |

(Continued)

*Primary Examiner* — Hemant M Desai
*Assistant Examiner* — Eduardo R Ferrero
(74) *Attorney, Agent, or Firm* — Mark P. Stone

(57) ABSTRACT

A device for a flushing head (3) of a rock drilling machine (1), which includes a machine housing (3) and, inside a cylinder (18), a to and fro moveable percussive piston (17) arranged to exert percussive action against a shank adapter (15), wherein the shank adapter has symmetry axis (19) and a flushing medium channel (22,23) for co-operation with a flushing medium chamber (24) in the flushing head (3) surrounding the shank adapter (15), said flushing head (3) being provided with a connection unit (7) for the connection to a flushing hose (10). The flushing head (3) and the machine housing (2) exhibit co-operating fastening means and fastening elements (6) in line with a force direction of tensile forces (F) being exerted by the flushing medium hose (10) on the connection unit (7) for movability of the flushing head (3) in respect of the machine housing (2) in directions perpendicular to said symmetry axis (19). The device also concerns a rock drilling machine including such a device.

20 Claims, 5 Drawing Sheets

(58) Field of Classification Search
CPC ... B23B 2250/12; B23B 2270/24; B23C 5/28; B23Q 11/10; E21B 21/00; E21B 21/02; E21B 21/015; E21B 17/03; E21B 17/18; E21B 4/18; E21B 7/18; E21B 17/02; E12B 21/00; E12B 21/015; E12B 21/02; B25D 2222/57
USPC .... 173/78, 218, 73, 199; 175/207, 209, 211, 175/214, 324
See application file for complete search history.

(56) References Cited

U.S. PATENT DOCUMENTS 3,620,312 A 11/1971 Krasnoff
3,893,521 A 7/1975 Bailey et al.
3,921,731 A * 11/1975 Ekwall ..... B25D 17/084 173/199
4,068,727 A * 1/1978 Andersson ..... B25D 17/08 173/1
4,387,775 A * 6/1983 Adolfsson ..... B25D 17/084 173/131
4,854,394 A * 8/1989 Heinonen ..... E21B 6/00 173/105
5,711,385 A * 1/1998 Brotherton ..... E21B 7/046 175/171
6,273,199 B1 * 8/2001 Kiikka ..... B25D 9/12 173/1
7,252,155 B2 * 8/2007 Goetzfried ..... B23B 51/042 173/117
7,841,803 B2 * 11/2010 Oberg ..... E21B 17/0426 173/1
7,967,084 B2 * 6/2011 Murray ..... E21B 7/025 173/197
8,002,051 B2 * 8/2011 Finkenzeller ..... E21B 4/18 175/209
2006/0283593 A1 * 12/2006 Robichaux ..... E21B 21/02 166/285
2006/0289154 A1 * 12/2006 Robichaux ..... E21B 17/05 166/85.1
2009/0242817 A1 * 10/2009 Strazhgorodskiy ..... E21B 19/16 251/315.16
2011/0073373 A1 * 3/2011 Rodert ..... B25D 17/005 175/94
2012/0285747 A1 * 11/2012 Nilsson ..... E21B 17/03 175/293
2013/0000939 A1 * 1/2013 Jonsson ..... B25D 9/12 173/200
2014/0262395 A1 * 9/2014 Connell ..... E21B 21/00 173/73
2015/0122117 A1 * 5/2015 Jonsson ..... E21B 1/02 92/165 R
2015/0321263 A1 * 11/2015 Thelin ..... B23B 27/08 407/11

FOREIGN PATENT DOCUMENTS

GB 2190032 11/1987
JP 4169694 6/1992
WO WO 9608606 A1 * 3/1996 ..... E02D 5/76
WO WO2008/100193 8/2008
WO WO2009/148375 12/2009
WO WO2011/074093 6/2011
WO WO2011/084093 7/2011

* cited by examiner

R
19
1
22
13
27
20,21
8
26
12
6
25
7
9
16
10
A
E 37
4
3
39
38
5
2
21
24
23

DEVICE RELATING TO A FLUSHING HEAD FOR A ROCK DRILLING MACHINE AND ROCK DRILLING MACHINE

FIELD OF THE INVENTION

The present invention relates to a device for a flushing head of a rock drilling machine, which includes a machine housing and, inside a cylinder, a to and fro moveable percussive piston arranged to exert percussive action against a shank adapter, wherein the shank adapter co-operates with the flushing head which is provided with a connection unit for the connection to a flushing hose. The invention also relates to a rock drilling machine including such a device.

BACKGROUND OF THE INVENTION

In order to introduce flushing medium into a flushing channel in a drill string during rock drilling it is previously known to provide rock drill machines for e.g. blast hole drilling with a flushing head which is connected to a flushing fluid source. The flushing head contacts the shank adapter over bushings and sealing devices and allows the shank adapter to rotate and perform a limited axial movement in respect of the flushing head during operation.

Different variants of such arrangements are previously known, wherein one solution is to arrange the flushing head fixed mounted in the machine housing of a drilling machine and another to position the flushing head supported floating for adapting to movements also in a radial direction of the shank adapter.

Since the operation of the drilling machine results in a risk of relatively considerable wear between the shank adapter and its bearing bushings in the machine housing, the radial movements of the shank adapter normally increases as a result of this increased wear. This results in that the first mentioned variant of a flushing head in turn being subjected to wear because of the increasing radial movements of the shank adapter, which leads to leakages at the flushing sealing devices and flushing medium escaping into the machine housing.

In the other one of said variants, the problem with the effect on the flushing head from the radial movements of the shank adapter because of bushing wear is reduced since the flushing head at a certain point is allowed to move together with the shank adapter. The previously known solution is however, still subjected to wear problems, is relatively complicated and requires the use of specially manufactured components.

As an example of the background art can be mentioned U.S. Pat. No. 4,854,394 and WO 2011/084093 A1.

THE AIM AND MOST IMPORTANT FEATURES OF THE INVENTION

It is an aim of the present invention to provide a device in respect of rock drilling machines according to the above which comprises a reliable and still economically practicable solution in respect of a flushing head of a rock drilling machine.

This aim is achieved in respect of a device of the above kind in that that the flushing head and the machine housing exhibit co-operating fastening means and fastening elements, that said co-operating fastening means and fastening elements are arranged essentially in line with a force direction of tensile forces being exerted by the flushing medium hose on the connection unit, in operation of the rock drilling machine, and that said co-operating fastening means and fastening elements are relatively moveable and thereby allows movability of the flushing head in respect of the machine housing in directions perpendicular to said symmetry axis.

With "In line with a force direction of tensile forces exerted by the flushing medium hose" is here intended a line comprising an imagined continuation of these tensile forces, wherein this line extends in the direction of the tensile forces and through their point of engagement with the flushing head. This normally means that, as seen in the impact direction of the rock drilling machine, said co-operating fastening means and fastening elements are positioned in front of the position where the hose is connected to the flushing head.

Hereby is obtained the advantage that the flushing medium hose which is drawn from the flushing medium source can be directly connected to the flushing head and that an effective means for receiving tensile forces being present in the flushing medium hose can be directly arranged in the machine housing without effecting the position and/or the alignment of a flushing head.

Hereby the problem occurring with previous floating suspended flushing heads is avoided which is that the flushing medium hose is fastened into different fastening means directly to the machine housing in order from that position to be passed on to the flushing head over a special component or a specially dimensioned hose or tube piece.

The invention also allows a place-saving solution since particular components extending laterally from a central or rear portion of the machine housing, as seen in the impact direction, can be avoided.

Such components in the form of hose attachment means can otherwise risk interfering with other equipment and therefore requires space close to the rock drilling machine.

The inventive solution further gives the flushing head the possibility to follow the movements in radial directions of the shank adapter, with little resistance, and without hindrance from fastening devices for the flushing medium hose, since the latter can be allowed to be free along the entire length of the machine housing.

This allows a greater freedom of movement of the hose in the region of the flushing head and thereby of it being subjected to restricting uneven loads because of a flushing medium hose being fastened close to the flushing head.

It is preferred that the device is constructed such that said co-operating fastening means and fastening elements are arranged in line with a longitudinal axis of the flushing medium hose at the connection unit, which is also in line with said force direction. In particular it is preferred that the construction is made such that the force direction is essentially parallel to said symmetry axis. This results in that an inventive device is logically producible without the requirement of an advanced force analysis for the construction.

Preferably the machine housing has a cavity for the flushing head in the region of a front part of the machine housing, whereby the flushing head is protected to a certain degree from external influences inside said cavity.

It is preferred that said fastening elements include a pin means having a pin axis and that said fastening means includes a seat surrounding the pin means and having a seat axis. In particular it is preferred that said pin axis and seat axis form essentially a right angle to said symmetry axis, at least when the device is not operational, and forms an essentially right angle thereto.

Preferably one of said co-operating fastening means and fastening elements is fastened to the flushing head and the other one of said co-operating fastening means and fastening elements is fastened to the machine housing. The flushing head is suitably produced with an integral fastening means or fastening element whereas said fastening means or fastening elements is releasably fastened to the machine housing for example with the aid of threaded fasteners.

It is preferred that an elastic element is arranged between said co-operating fastening means and fastening elements in order to obtain a flexible movability between the details. This element can be a spring device of different kinds but is preferably a resilient bushing. Such a bushing is suitably manufactured from a suitable rubber or rubber like material.

Preferably a play is provided between the resilient bushing and at least one of said co-operating fastening means and fastening elements in order to allow movability between the flushing head and the machine housing. A resilient bushing can very well be arranged with a play in respect of one of said co-operating fastening means or fastening element or in respect of both of them.

It is possible to arrange that said fastening elements and fastening means are interconnected over an elastically yielding link, which extends along the force direction.

In order to further control the movements of the flushing head it is suitable that it is supplemented with an arrangement for inside stabilizing of the flushing head. This can be realized in such a way co-operating means are arranged on the one hand on the flushing head, on the other hand in the cavity. These means are thereby constructed to allow movements of the flushing head in radial direction, seen from the symmetry axis but preventing movements in axial direction.

It is suitable that a position of said co-operating fastening means and/or fastening element is adjustable as seen in said force direction in order to e.g. compensate for wear of the details involved etc.

The flushing head is suitably of the kind having, on each side of the flushing medium chamber, a bearing bushing and a flushing sealing device for the co-operation with the shank adapter.

The invention also relates to a rock drilling machine including machine housing and, inside a cylinder, a to and fro moveable percussive piston including a device according to the above.

BRIEF DESCRIPTION OF DRAWINGS

The invention will now be described in greater detail by way of embodiments and with reference to the annexed drawings, wherein:

FIGS. 4 and 4*a* show details of a front part of a second alternative rock drilling machine in an enlarged scale, partly in section.

DESCRIPTION OF EMBODIMENTS

In the following detailed description, similar components have partly been depicted with the same reference signs.

Figure 1:
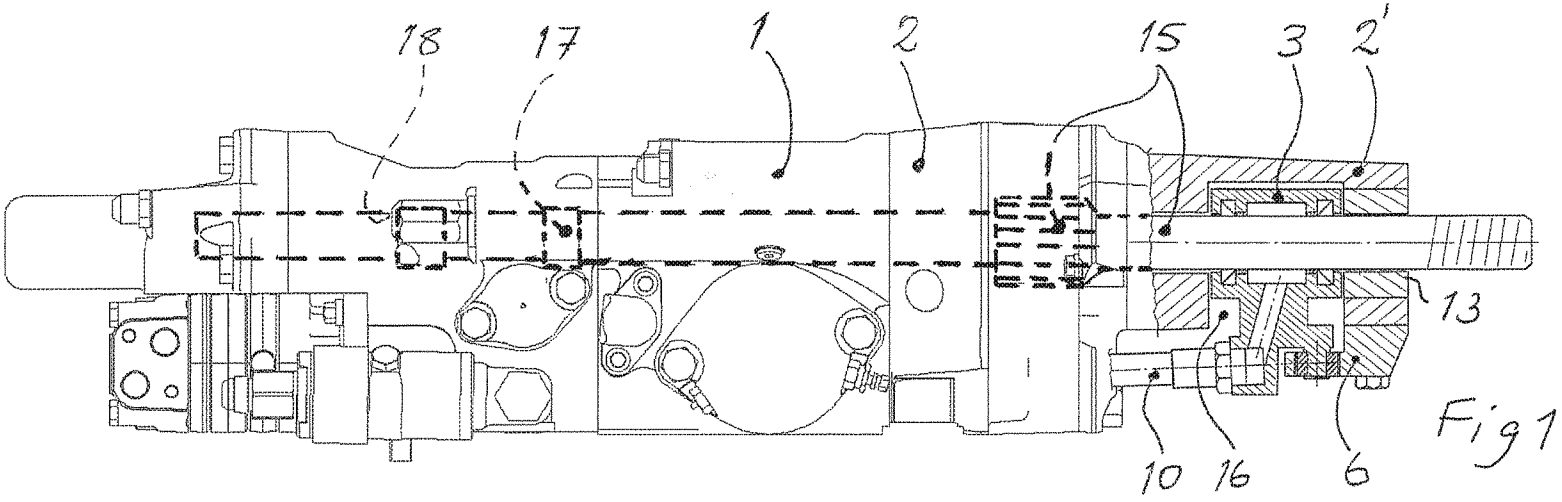
FIG. 1 diagrammatically shows a rock drilling machine equipped with a device according to the invention.

FIG. 1 shows a rock drilling machine 1, which is adapted for drilling blast holes that are relatively narrow drill holes. The rock drilling machine 1 exhibits a machine housing 2 with a percussive piston 17 for movement inside the cylinder 18 and for percussive action against a shank adapter 15. The shank adapter 15 is as usual moveable inside a bushing 13 and is connectable to drill string components of a drill string (not shown), which at its most distal end supports a drill bit.

For flushing purposes, the rock drilling machine 1 is provided with a flushing head 3 communicating with the shank adapter 15, said flushing head 3 in turn being connected to a flushing medium hose 10 for transfer of flushing medium from a (not shown) flushing medium source over the flushing head 3 into channels in the shank adapter 15 for further transport through the drill string and all the way to said drill bit.

From FIG. 1 is further evident that the flushing head 3 is arranged in a cavity 16 in the frontal part 2' of the machine housing 2, that the flushing head 3 in an normal manner surrounds the shank adapter 15 and that the flushing head 3 over co-operating fastening means and fastening elements globally indicated with references numeral 6, is fastened to said front part 2'.

Figure 2:
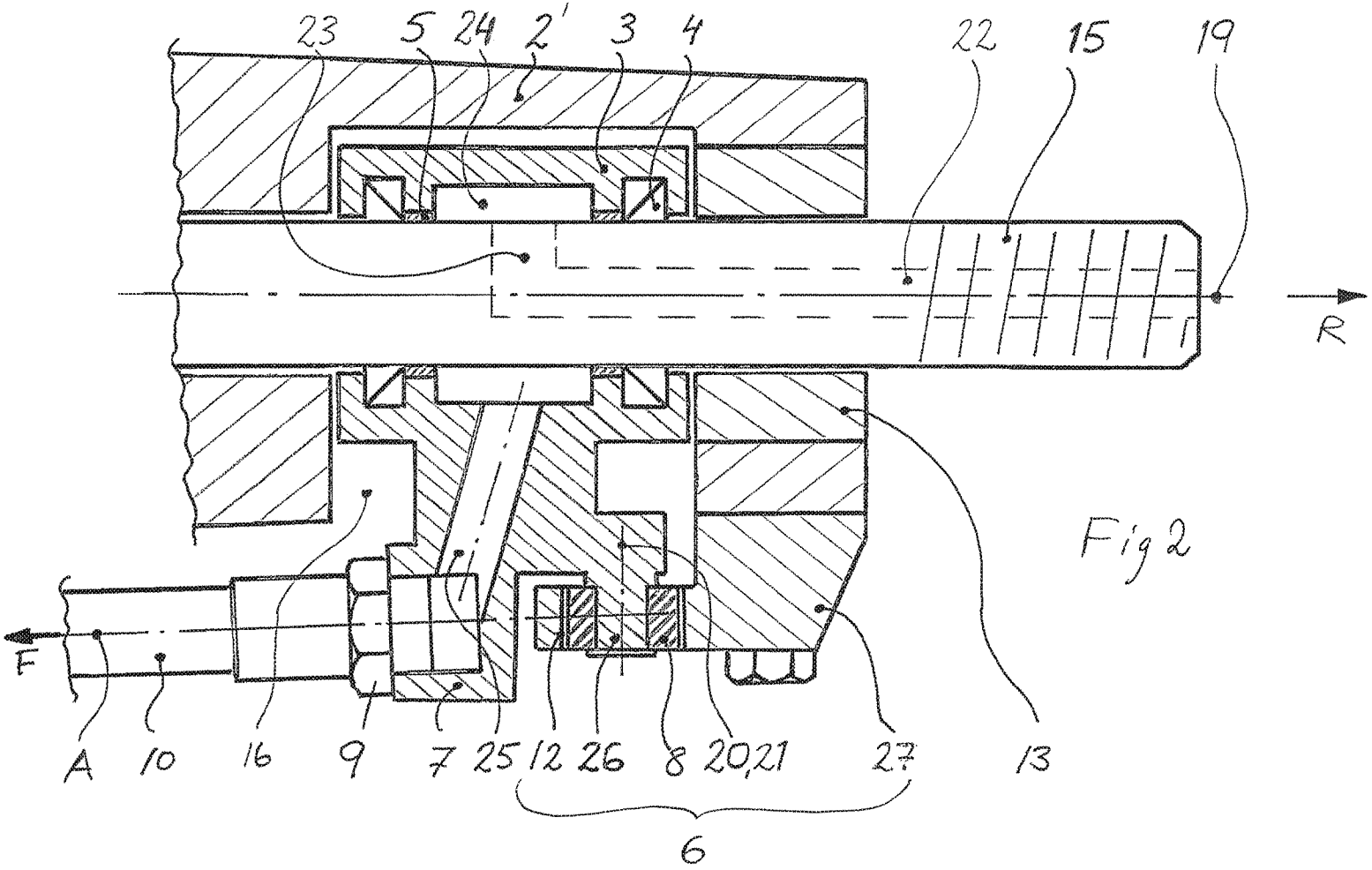
FIG. 2 shows a detail of a front part of the rock drilling machine in FIG. 1 in an enlarged scale, partly in a section.

The enlarged sectional view in FIG. 2 shows the invention more in detail with the flushing head 3 placed in the cavity 16 in the front part 2' of the machine housing 2. The flushing head 3 exhibits a flushing medium chamber 24, which on both sides has a bearing bushing 5 acting against the shank adapter 15 and a flushing sealing device 4.

The flushing head 3 is connected to a flushing medium hose 10 for providing flushing medium being brought into the flushing head over a connection unit 7 which receives and, together with a fastening nut 9, fixes the flushing medium hose 10. Incoming flushing medium is passed from the connection unit 7 through an introduction channel 25 to the flushing medium chamber 24. The flushing medium is transmitted therefrom to a flushing medium channel 22 being arranged centrally in the shank adapter 15 over one or more radial channel portions 23 in level with the flushing medium chamber 24.

During drilling with the rock drilling machine, a stretching force or a tensile force F acts on the flushing medium hose 10 in a force direction in the direction of a longitudinal axis A of the flushing medium hose 10. This tensile force F emanates from (not shown) hose tensioning means which are arranged on a drill rig supporting the rock drilling machine. The hose tensioning means i.a. aim to prevent excessive oscillating movements of the flushing medium hose 10 in operation by stretching it.

With the above mentioned "In line with a force direction of tensile forces exerted by the flushing medium hose" is in this case meant in line with said longitudinal axis A of the flushing medium hose 10.

The tensile force F is of such a magnitude that it could potentially affect the alignment and the position of the flushing head 3 inside the rock drilling machine. According to the invention, therefore said co-operating fastening means and fastening element 6 are arranged for the reception of this tensile force F.

Said co-operating fastening means and fastening element 6 include means on the flushing head 3 and on the front part 2' of the machine housing 2, respectively. In FIG. 2 is shown an embodiment of an arrangement, wherein on the flushing head 3 there is arranged a protruding pin means 26, having a cylindrical bearing surface and having a pin axis 20 forming an essentially right angle to and intersecting a symmetry axis 19 of the shank adapter 15.

The front part 2' further exhibits a seat 12 for the reception of the pin means 26, said seat having a cylindrical inside bearing surface with a seat axis 21 which likewise is essentially perpendicular to and intersects the symmetry axis 19.

In theory the pin axis 20 is identical to the seat axis 21, but in practice, because of resilience, intentional play and wear there is a slight deviation in lateral position as well as in parallelism between this axes.

The seat 12 is formed in a protrusion being equipped with said circular bearing surface, said protrusion extending from a portion of the front part 2' being positioned in an imagined continuation forwardly, as seen in the impact direction R, of the longitudinal axis A of the flushing medium hose (in the region of the connection unit 7), along which said tensile force F is effective.

A central portion of said bearing surface in the seat 12 as well as a central portion of said bearing surface on the pin means 26 therefore are located essentially in line with said longitudinal axis A such that a continuation of the line of action of the tensile force F acts essentially centrally on the pin means as well as on the seat. Hereby said tensile force F will be received effectively by the machine housing through said co-operating fastening means and fastening elements 6 without influencing the position and the alignment of the flushing head 3.

In the shown embodiment, a resilient bushing 8, for example of a rubber material, is arranged in the seat 12 and is surrounding the pin means 26. This bushing allows movements between the pin means 26 and the seat 12.

Further, the bushing 8 is suitably received inside the seat 12 and/or vis-à-vis the pin means 26 with a certain small play in order to minimize the resistance against movements between the flushing head and the front part 2' in operation of the device, when the shank adapter can be expected to exert movements in radial directions.

In FIG. 2 there is shown on the front part 2' a releasable part 27 which extends, as seen in the impact direction, rearwardly over the cavity 16 and which includes said protrusion and thereby said seat 12. For disassembly of the flushing head 3, the part 27 is simply removed in order to allow unrestricted access to the cavity 16.

Figure 3:
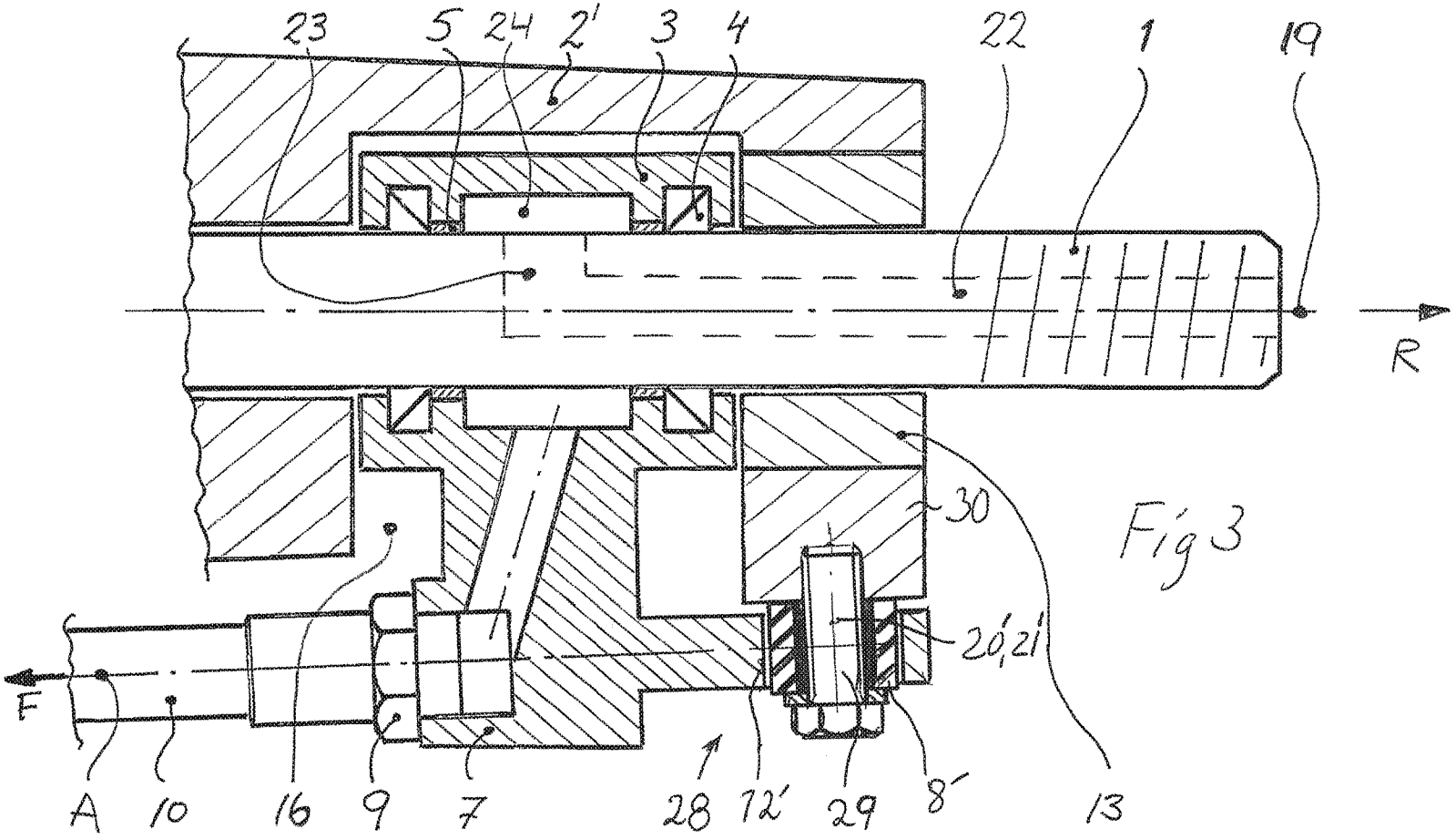
FIG. 3 shows a detail of a front part of a first alternative rock drilling machine in an enlarged scale, partly in section.

A second embodiment of the invention is shown in FIG. 3, wherein the flushing head 3 has a protrusion 28 protruding in line with the longitudinal axis A of the flushing medium hose 10 and in the impact direction R, said protrusion 28 having a seat 12' with a cylindrical inside bearing surface with the seat axis 21', which is essentially perpendicular to and intersects with the symmetry axis 19. A pin means 29 with an outside cylindrical bearing surface and with a pin axis 20', likewise forming an essentially right angle to and intersecting the symmetry axis 19, is constructed in the form of a bolt with a sleeve being screwed into a front portion 30 of the front part 2' surrounding the shank adapter 15.

The pin means 29 and the surrounding seat 12' is also in this case positioned in an imagined continuation forward, as seen in the impact direction R, of the longitudinal axis A of the flushing medium hose, along which said tensile force F is active. A central portion of said bearing surface in the seat 12' as well as a central portion of said bearing surface on the pin means 29 are thereby located essentially in line with the longitudinal axis A, such that a continuation of the action line of the tensile force F engages essentially centrally on the pin means as well as on the seat. Hereby said tensile force F will be received by the machine housing by said co-operating fastening means and fastening elements 6 without influencing the position and the alignment of the flushing head 3 corresponding to what is discussed above. A resilient bushing 8', for example of a rubber material, is arranged correspondingly to what is discussed above in order to allow relative movements between the components.

Figure 4:
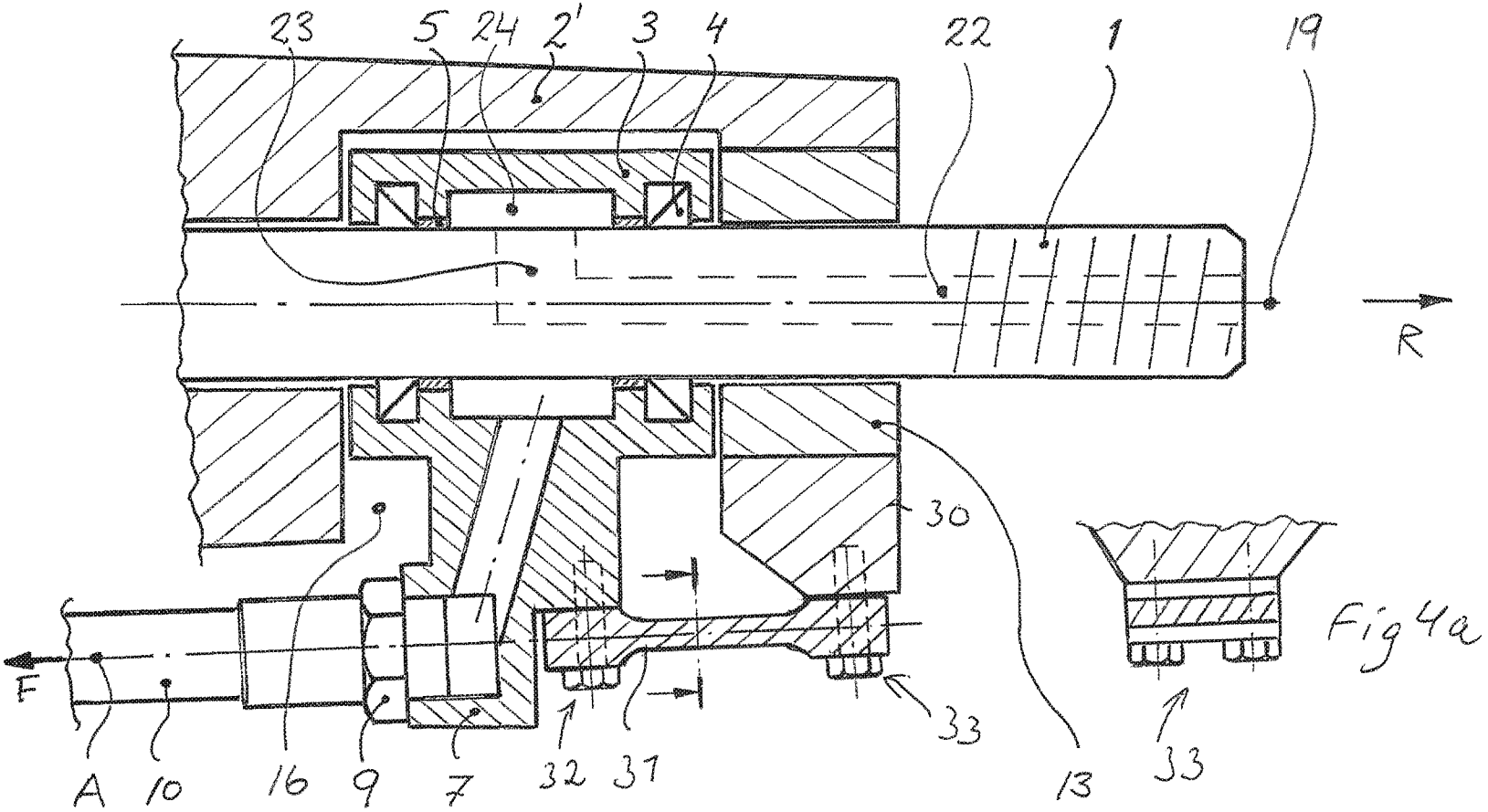

FIG. 4 shows a third embodiment of the invention, wherein the tensile force F acting on the flushing head is relieved by an elastically yielding link 31 at least partly made from an elastic material. The link 31 has an extension in a continuation of the action line of the tensile force F for achieving the same or corresponding relieving action as is explained above. The link 31 is fastened on the one hand to the flushing head 3 with fastening element 32, on the other hand at a forward region 30 of the front part 2' with fastening means 33. Fastening elements—fastening means 32 and 33 co-operate according to this embodiment over said link 31 and are shown as screws but can also be in the form of other suitable fastening means. FIG. 4*a* shows the link 31 in a section, wherein is illustrated that it has a rectangular plate-shaped cross section.

Also other embodiments are possible, wherein one means fastened in a similar manner on one of the components is joined to an element being fastened to the other one of the components over a non-rigid intermediate means of other form than plate shape, such that relief of the tensile force is obtained at the same time as the desired relative movability between the flushing head and the machine housing is possible.

Figures 5, 5A:
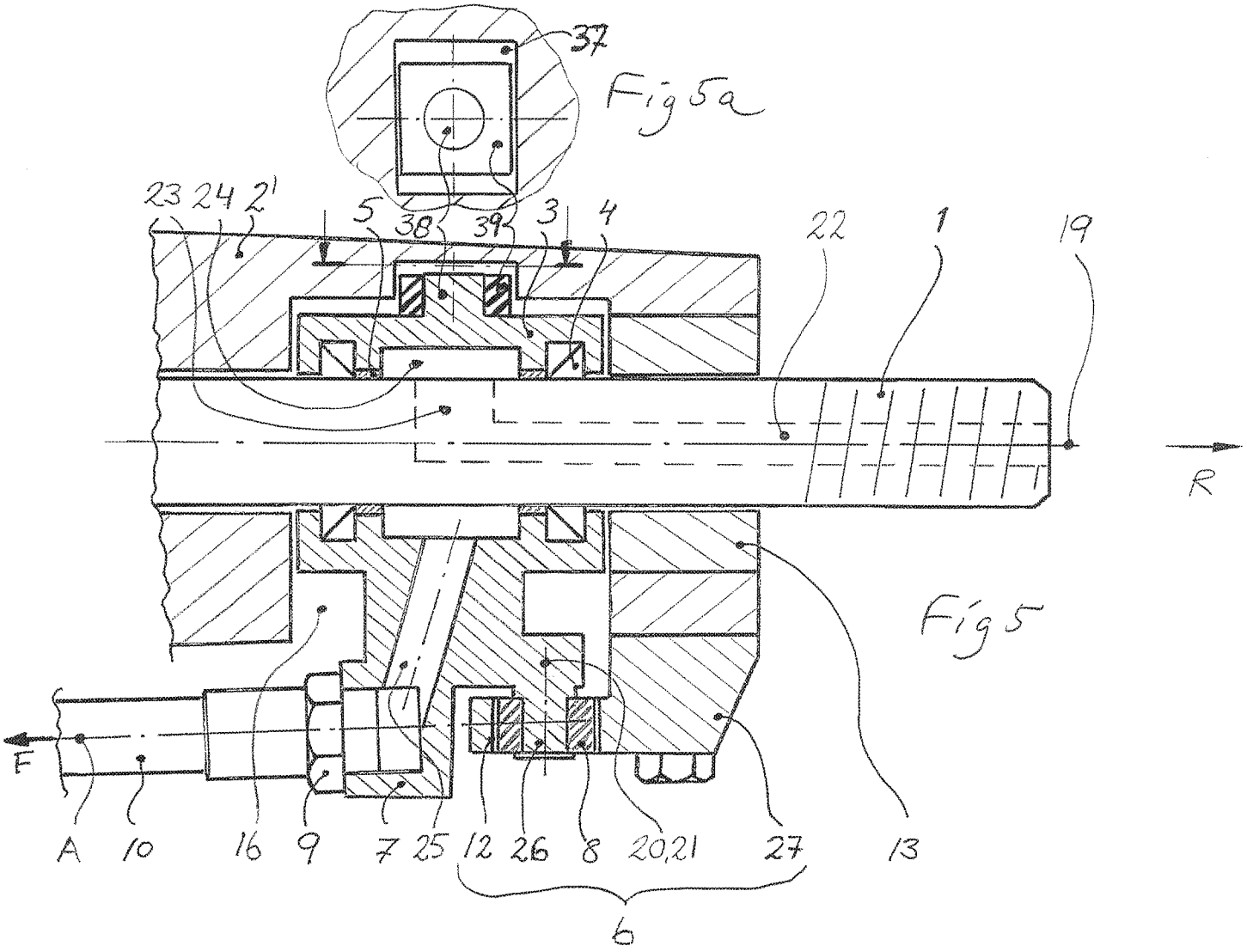
FIGS. 5 and 5*a* show details of a front part of a third alternative rock drilling machine in an enlarged scale, partly in section.

FIG. 5 concerns an embodiment essentially corresponding to the one shown in FIG. 2. The embodiment in FIG. 5 is, however, supplemented with an arrangement for inside stabilizing of the flushing head 3 at a distance from align comprising the imagined continuation of the tensile force F, which also in this case is along the continuation of the longitudinal axis A of the flushing medium hose 10. This arrangement includes a recess 37 having a rectangular section and being in the front part 2' into which engages a pin means 38 having a circular section and being surrounded by an elastic bushing 39 with a section having rectangular outer contour. A smaller play is arranged between plane bearing surfaces of the recess 37 and the bushing 39, said bearing surfaces extending at a right angle to the symmetry axis 19 of the shank adapter.

Between surfaces of the recess and the bushing extending in parallel to the symmetry axis 19 of the shank adapter there is a large play such that in practice in operation, these surfaces will never come into contact with each other.

Through this construction, relative movement in radial direction is allowed of an inner portion of the flushing head and the front part 2', for example during radial movements of the shank adapter, simultaneously with the stabilization of the movements of the flushing head in an axial direction by preventing or at least limiting movements being parallel to the symmetry axis 19 of the shank adapter at the inner part of the flushing head at a distance from said line comprising the imagined continuation of the tensile force F.

The invention can be modified further within the scope of the following claims. The co-operating fastening means and fastening elements can thus be constructed otherwise. The pin means shown in the Figures has one free end. It is, however, also possible to arrange a pin means having support at both ends by portions of the flushing head or at occasions by portions of the machine housing.

It is possible to arrange the flushing medium hose connection to the flushing head 3 in different ways. On FIG. 2-5 there are shown variants wherein an action line of the tensile forces F is essentially parallel with the symmetry axis 19. Also other embodiments can, however, exist, for example wherein an axis through the connection unit 7 forms an angle with the symmetry axis 19.

Also in such cases the invention is applicable, but it will then be necessary to provide a force analysis in order to provide an alignment between a true tensile force and the direction wherein said co-operating fastening means and fastening elements 6 are to be applied in order to effectively receive this tensile force and prevent that force or moment is/are transmitted to the flushing head such that an excessive wear and thereby associated problems occur. For that reason such embodiments are not preferred.

It is possible to arrange adjustment means in order to achieve that a position of one of said co-operating fastening means and/or fastening elements (or even both) is adjustable as seen in said force direction. This can be realized in that for example the seat is displaceable in said force direction. In the case of an elastic link, plate or the like as in FIG. 4, the fastening point of the link can be adjustable through being displaceable, positioning of inlays of varying diameters into fastening holes etc.

The invention is not limited to machines for blast hole drilling but is applicable also in other types of rock drilling machines.

The invention claimed is:

1. Device for a flushing head (2) of a rock drilling machine (1), which includes a machine housing (3) and, inside a cylinder (18), a to and fro moveable percussive piston (17) arranged to exert percussive action against a shank adapter (15), wherein the shank adapter has a symmetry axis (19) and a flushing medium channel (22,23) for co-operation with a flushing medium chamber (24) in the flushing head (3) surrounding the shank adapter (15), said flushing head (3) being provided with a connection unit (7) for the connection to a flushing hose (10), wherein:

said flushing head and said machine housing are connected together by co-operating fasteners on the flushing head and on the machine housing, respectively, said co-operating fasteners (6) are arranged essentially in line with a force direction of tensile forces (F) being exerted by the flushing medium hose (10) on the connection unit (7) so as to allow movement of the flushing head in an axial direction of the shank adapter, during operation of the rock drilling machine (1), and said co-operating fasteners (6) are moveable relative to each other thereby allowing movement of the flushing head (3) relative to the machine housing (2) in directions perpendicular to said symmetry axis (19).

2. Device according to claim 1, wherein said force direction is in line with a longitudinal axis (A) of the flushing medium hose (10) at the connection unit (7).

3. Device according to claim 2, wherein the force direction is essentially parallel to said symmetry axis (19).

4. Device according to claim 2, wherein the machine housing (2) has a cavity (16) for the flushing head in the region of a front part (2') of the machine housing (2).

5. Device according to claim 2, wherein said fastener on said flushing housing includes a pin (26) having a pin axis (20) and that said fastener on said machine housing includes a seat (12) surrounding the pin (26) and having a seat axis (21).

6. Device according to claim 1, wherein the force direction is essentially parallel to said symmetry axis (19).

7. Device according to claim 1, wherein the machine housing (2) has a cavity (16) for the flushing head in the region of a front part (2') of the machine housing (2).

8. Device according to claim 1, wherein said fastener on said flushing housing includes a pin (26) having a pin axis (20) and that said fastener on said machine housing includes a seat (12) surrounding the pin (26) and having a seat axis (21).

9. Device according to claim 8, wherein said pin axis (20) and seat axis (21) form essentially a right angle to said symmetry axis (19).

10. Device according to claim 1, wherein one of said co-operating fasteners is connected to the flushing head (3) and the other one of said co-operating fasteners is connected to the machine housing (2).

11. Device according to claim 1, wherein an elastic element is arranged between said co-operating fasteners on said machine housing and said flushing head.

12. Device according to claim 11, wherein the elastic element is a resilient bushing (8).

13. Device according to claim 12, wherein the resilient bushing (8) and at least one of said co-operating fasteners are arranged to allow movability between the flushing head and the machine housing.

14. Device according to claim 1, wherein a position of said fastener on said machine housing, and/or said fastener on said flushing head, is adjustable as seen in said force direction.

15. Device according to claim 1, wherein the flushing head (3) on each side of the flushing medium chamber (24) is provided with a bearing bushing (5) and a flushing sealing device (4) for the co-operation with the shank adapter (15).

16. Rock drilling machine (1) including a machine housing (2) and, inside the cylinder (18), a to and fro moveable percussive piston (17), wherein said rock drilling machine includes a device according to claim 1.

17. Device according to claim 1, wherein the flushing head has a protruding portion (28) extending from said connection unit, said protruding portion having a longitudinal axis aligned with the longitudinal axis of the flushing medium hose, the fastener on the flushing head being provided on the protruding portion.

18. Device for a flushing head (2) of a rock drilling machine (1), which includes a machine housing (3) and, inside a cylinder (18), a to and fro moveable percussive piston (17) arranged to exert percussive action against a shank adapter (15), wherein the shank adapter has a symmetry axis (19) and a flushing medium channel (22,23) for co-operation with a flushing medium chamber (24) in the flushing head (3) surrounding the shank adapter (15), said flushing head (3) being provided with a connection unit (7) for the connection to a flushing hose (10) , wherein:

said flushing head and said machine housing are connected together by co-operating fasteners on the flushing head and on the machine housing, respectively, said co-operating fasteners (6) are arranged essentially in line with a force direction of tensile forces (F) being exerted by the flushing medium hose (10) on the connection unit (7), and said co-operating fasteners on said machine housing and said flushing head are interconnected over an elastically yielding link (31).

19. Device for a flushing head (2) of a rock drilling machine (1), which includes a machine housing (3) and, inside a cylinder (18), a to and fro moveable percussive piston (17) arranged to exert percussive action against a shank adapter (15), wherein the shank adapter has a symmetry axis (19) and a flushing medium channel (22,23) for co-operation with a flushing medium chamber (24) in the flushing head (3) surrounding the shank adapter (15), said flushing head (3) being provided with a connection unit (7) for the connection to a flushing hose (10), wherein:

said flushing head and said machine housing are connected together by co-operating fasteners on the flushing head and on the machine housing, respectively, said co-operating fasteners (6) are arranged essentially in line with a force direction of tensile forces (F) being exerted by the flushing medium hose (10) on the connection unit (7), and wherein the machine housing (2) has a recess (37) in the region of a front part (2') of the machine housing (2), and wherein said device further includes an arrangement (38, 39) for stabilizing of the flushing head at a distance from said force direction, wherein said arrangement includes components on the flushing head cooperating with the recess in the machine housing for allowing movements of the flushing head in radial direction, as seen from the symmetry axis, but preventing movements in an axial direction.

20. Device according to claim 19, wherein said components on said flushing head include a pin surrounded by an elastic bushing.

* * * * *